US007534176B1

(12) United States Patent
McNary

(10) Patent No.: US 7,534,176 B1
(45) Date of Patent: May 19, 2009

(54) PUCK BASE DEFLECTING TRAINING DEVICE AND METHOD

(76) Inventor: David F. McNary, 12 Shields St., Woburn, MA (US) 01801

( * ) Notice: Subject to any disclaimer, the term of this patent is extended or adjusted under 35 U.S.C. 154(b) by 291 days.

(21) Appl. No.: 11/484,497

(22) Filed: Jul. 11, 2006

Related U.S. Application Data

(63) Continuation-in-part of application No. 10/763,960, filed on Jan. 26, 2004, now Pat. No. 7,074,140.

(51) Int. Cl.
*A63B 69/00* (2006.01)

(52) U.S. Cl. ..... 473/446; 273/400

(58) Field of Classification Search ..... 473/446; 188/32; D12/217
See application file for complete search history.

(56) References Cited

U.S. PATENT DOCUMENTS

| | | | | |
|---|---|---|---|---|
| 213,203 | A * | 3/1879 | Jewell | 188/32 |
| 1,915,320 | A * | 6/1933 | Jones | 248/188.2 |
| D386,462 | S * | 11/1997 | McCune et al. | D12/217 |
| 6,622,960 | B2 * | 9/2003 | Hyde | 242/615 |
| 6,648,103 | B2 * | 11/2003 | Scheffer | 188/32 |
| 7,074,140 | B1 * | 7/2006 | McNary | 473/446 |
| 2003/0228942 | A1 * | 12/2003 | Hsieh | 473/446 |

* cited by examiner

*Primary Examiner*—Gene Kim
*Assistant Examiner*—Mike Chambers
(74) *Attorney, Agent, or Firm*—William Nitkin

(57) ABSTRACT

An ice hockey training device providing goalie training in preventing pucks, particularly deflected or "tipped" pucks, from entering an ice hockey goal is disclosed. The device is disposed on a playing surface in front of a goal guarded by a goalie. The device consists of a base deflector having a planar surface in one embodiment of the invention disposed at an upward angle which can direct pucks traveling on the playing surface that are hit by a player to ride up onto the upwardly angled planar surface of the base deflector and be directed upwards at the goal. In other embodiments a plurality of angled members can be disposed on the top surface of the base deflector, causing a puck traveling in a first path of travel and striking one or more of such angled members to be directed upwards at the goal at a second path of travel. In a further embodiment a plurality of dome-shaped members can be disposed on the top surface of the base deflector, causing a puck traveling in a first path of travel and striking one or more of such dome-shaped members to be directed upwards at the goal at a second path of travel.

1 Claim, 4 Drawing Sheets

PUCK BASE DEFLECTING TRAINING DEVICE AND METHOD

This application is a continuation-in-part of my prior application entitled Puck-deflecting Training Device filed Jan. 26, 2004 Ser. No. 10/763,960 now U.S. Pat. No. 7,074,140.

BACKGROUND OF THE INVENTION

1. Field of the Invention

The device and method of this invention reside in the area of sporting equipment and more particularly relate to a training device for use by ice hockey players which device, when in use, causes deflections of pucks hit at short range and provides training for goalies for preventing deflected pucks from entering an ice hockey goal.

2. History of the Prior Art

An ice hockey goalie stands in the crease in front of an ice hockey goal and attempts to stop pucks from entering the goal that are shot at the goal by members of the opposing team. The puck can be shot at the goal by members of the opposing team from a distance, at very close range or the puck can be shot or passed from one player to another and then shot at the goal, giving the goalie very little time to react to the puck's change in direction of travel. The puck can also be deflected or "tipped" off the hockey stick blade, on its way toward the goal by a second player from a first player's shot, resulting in a different angle of puck movement toward the goal. Such tipped shots are more difficult for a goalie to catch or prevent from entering the goal because there is less time to gauge the direction of travel of the puck.

SUMMARY OF THE INVENTION

It is an object of the device and method of this invention to duplicate the tipping deflections of pucks that frequently occur in a real ice hockey games for use by goalies during team practice and goalie training sessions.

It is a further object of this invention to cause deflection of a puck near the goalie that is shot by a player at a distance from the goal so that the goalie can practice trying to stop or catch a puck that is deflected before coming into the goalie's vicinity.

It is a still further object of this invention to provide a device that will deflect the path of travel of pucks traveling along the surface of the ice.

It is yet a further object of this invention to provide a training device that is easy to ship, easy to assemble and easily maneuverable on the ice of an ice hockey rink or rink with synthetic "ice," such as plastic playing surfaces or equivalent. It should be understood that all references made to ice include such equivalent playing surfaces.

The device of this invention consists of an angled base member disposed on the ice having a plurality of puck deflectors disposed on its upper surface. The device can be placed at a desired distance in front of a hockey goal during a practice session. The device in one embodiment can be placed between 6-12 feet in front of the goal. In use, a single player can shoot a puck at the device of this invention in front of the goal; and the puck will first rise up the base member's angled surface and then may strike one of the puck deflector members and be deflected at an angle from its original path direction, such angle determined by the manner in which the puck strikes a puck deflector member, thus increasing the difficulty for the goalie in preventing the puck from entering the goal.

This increase in difficulty in gauging the path of the deflected puck is desirable for providing specialized goalie practice training.

The base deflector in one embodiment of this invention has a plurality of angled members or raised or dome-shaped areas disposed on its upwardly angled upward surface and can be positioned, in one embodiment, beneath the plurality of puck deflector members, as described in U.S. Pat. No. 7,074,140 for deflecting pucks traveling on the surface of the ice which then travel onto the angled surface of the base deflector to cause such pucks to be lifted upwards at an angle in one direction of travel and then be deflected by striking the angled members or raised areas along a second direction of travel near the goal. The base deflector can be used in conjunction with a tip trainer or, if desired, can be used separately to cause a puck traveling onto the surface of the base deflector to become airborne at different angular paths for further ice hockey practice for improving the skills of the goalie and his team. In the instance when a puck will miss striking an angled member or a raised area, the puck's direction of travel will not change, and the puck's direction of travel over the base deflector will cause the puck's direction of travel to be angled upwards.

In some embodiments of the invention the base deflector can have a generally planar surface with no angled or dome-shaped members thereon, and the puck's direction of travel over the base deflector will cause the puck's direction of travel to be angled upwards.

DESCRIPTION OF THE PREFERRED EMBODIMENT(S)

Figure 1:
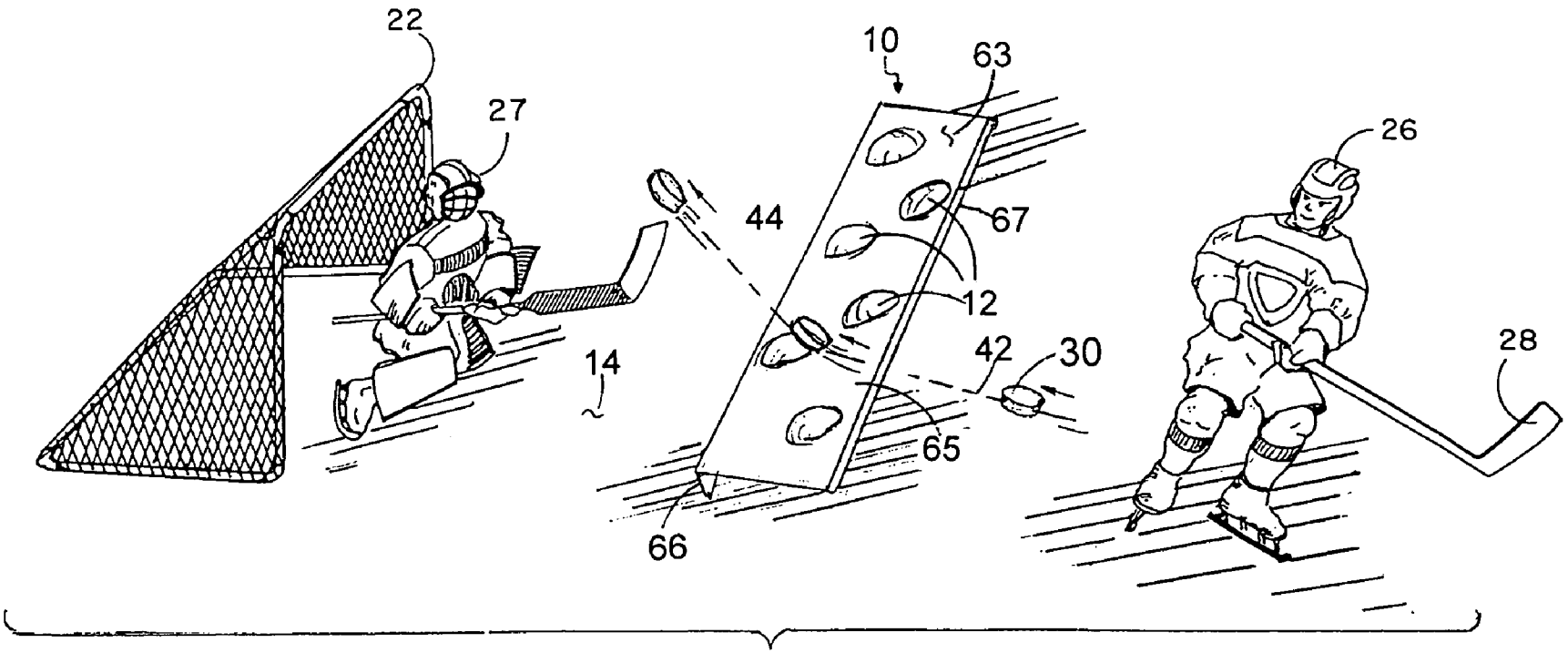
FIG. 1 illustrates a side perspective view of the tip training device of this invention in use disposed between a hockey player and a goal with a goalie positioned in front of the goal.

FIG. 1 illustrates a side perspective view showing base deflector 10 of this invention disposed in front of goalie 27 who is standing in front of hockey goal 22. Player 26 shoots puck 30 with hockey stick 28 such that the puck, as it passes up onto upwardly angled base deflector 10. As seen in FIG. 1, puck 30 travels along first path 42 from the point where it is first struck by a player's hockey stick. Puck 30 then strikes one of the puck deflector members 12 on base deflector 10 and is then deflected from its original first path 42 to a second path 44 at an angle where goalie 27, who is positioned in front of the goal, must then try to catch or block the deflected or "tipped" puck from entering the goal. Having little time to react to the puck's new direction of travel, the goalie must be constantly alert and must exercise quick reflexes to catch or block the deflected puck from entering the goal.

Figure 2:
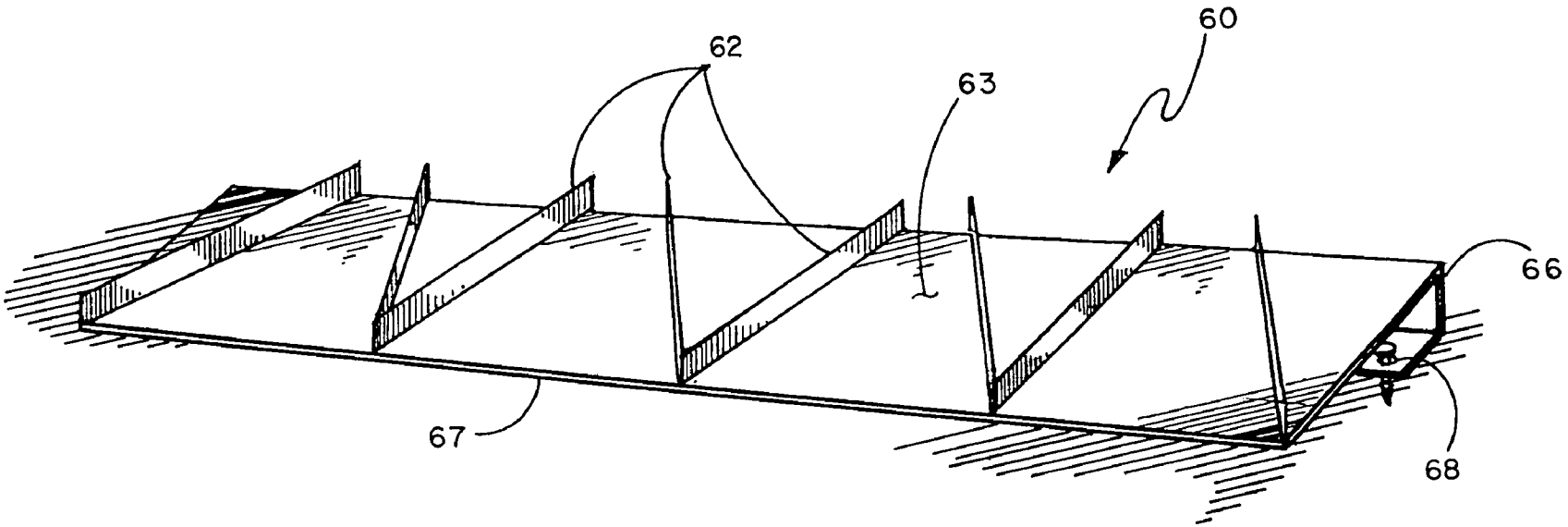
FIG. 2 illustrates a perspective view of the base deflector in the embodiment having a plurality of angled members thereon.

As seen in FIG. 1, the surface of base deflector 10 has planar portions 63. Planar portion 63 is angled upwards towards its rear, forming a ramp, and its front 67 rests on the ice. Base deflector 10 can be made of ¼ inch thick polycarbonate and have a plurality of randomly placed dome-shaped members molded into the surface. In a preferred embodiment the base deflector can be approximately 60 inches wide, 14 inches deep and riser 66 can be approximately 1-2 inches high. The dome-shaped members can be between 1-4 inches in height, and have a diameter of 3-6 inches. The dome-shaped members 12 can be "bumps" of hemispherical shape but do not necessarily have to be round and can also be formed of irregular-shaped protrusions. They can be randomly placed on the planar surface or integrally molded as part of the surface of the base deflector. When the puck is deflected, it is deflected not only upwards on the ramp but when it strikes an angled or dome-shaped member, it direction of travel is deflected sideways in unpredictable directions, causing random puck deflections generally in the direction of the goalie making it difficult for the goalie to catch or stop the puck and allowing the goalie to better his skills in reacting to the oncoming puck. Base deflector 10 at its rear can be supported in a raised position by riser 66 which can be approximately 1-2 inches in height, causing surface 63 to be disposed at an upward angle to the ice so that a puck coming from front 67 will slide at an upwards angle from the ice along the surface of planar portion 63. A height adjuster, such as a screw member 68 attached to riser 66, as seen in FIG. 2, can be utilized to raise or lower riser 66, if desired. Other equivalent means of raising or lowering the upward angle of surface 63 can also be utilized such as providing longer and/or shorter risers 66. In an alternate embodiment base deflector 10 can have a plurality of angled members 62, as seen in FIG. 2, disposed at various angles to one another on surface 63 which angled members 62 can extend upward about 1 inch perpendicular to surface 63 such that when a puck enters onto planar surface 63 at front 67 of base deflector 10, it will most likely strike one of the angled members 62 and then rebound thereof at a different angle than the angle at which it was originally shot.

Figure 3:
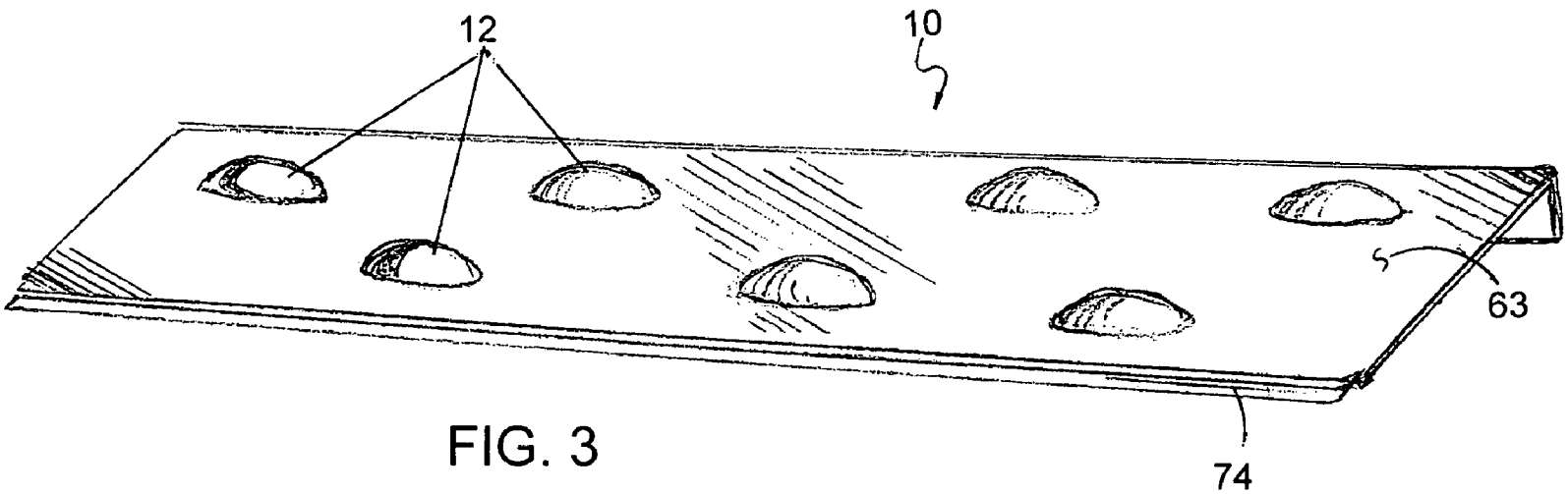
FIG. 3 illustrates a perspective view of the embodiment of the base deflector having raised or dome-shaped areas thereon.

FIG. 3 illustrates an alternate embodiment of base deflector 10 of this invention which has a nonadjustable riser 66 at its rear and a metal lip 74 disposed along its front to make better contact with the ice on which the unit rests. Disposed at various positions along the upper surface 76 of the base deflector 10 are a plurality of domed areas 12 which can be in the nature of round bumps disposed at various positions along the upper surface of puck deflector 10. When a puck traveling in a first path of travel strikes one of these bumps, depending on where it strikes the bump, the puck will be deflected at an angle causing the puck to travel along a second path of travel that is related to the angle of the portion of the bump that it struck.

Figure 4:
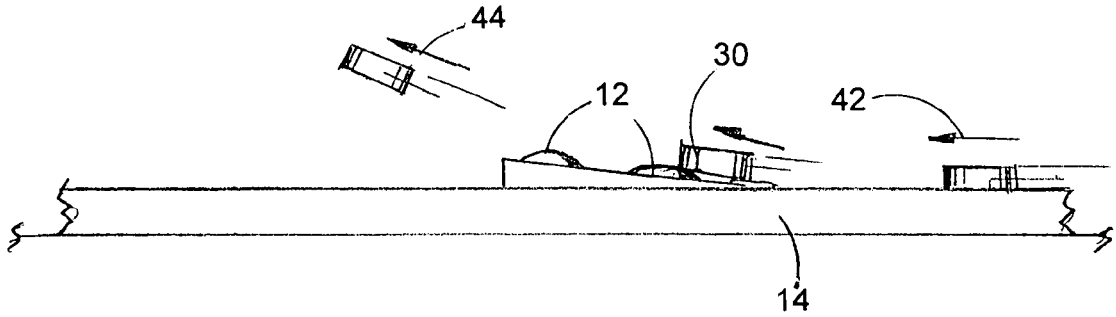
FIG. 4 illustrates a side view of the embodiment of the base deflector of FIG. 3 having raised areas, showing a puck traveling thereover in a first direction of travel and striking one of the deflector members which action causes the puck to travel in a second direction of travel.

FIG. 4 illustrates a side view of the embodiment of the puck deflector having a plurality of dome-shaped members 12 wherein puck 30 is shown traveling on the ice along a first path 42 and then traveling onto base deflector 10 where it strikes one of the dome-shaped members 12, causing the puck to travel along a second path 44.

Although the present invention has been described with reference to particular embodiments, it will be apparent to those skilled in the art that variations and modifications can be substituted therefor without departing from the principles and spirit of the invention.

I claim:

1. An ice hockey training device for use on an ice surface in conjunction with a hockey puck, said device disposed in front of a hockey goal guarded by a goalie, comprising:

a base deflector being approximately 60 inches wide and approximately 14 inches deep having a bottom, top surface, front and a rear, said bottom of said base deflector for placement on said ice surface a distance between 6-12 feet in front of said hockey goal, said base deflector having a planar top surface which is angled upwards a height of approximately 1-2 inches high at said rear from said front to said rear toward said hockey goal; and a plurality of dome-shaped members disposed on said top surface of said base deflector, each of said dome-shaped members having a height between 1-4 inches and a diameter of 3-6 inches, said plurality of dome-shaped members for deflecting said hockey puck that strike different ones of said dome-shaped members that are shot along said ice surface along a first path of travel, said striking causing said pucks to be deflected and to move along a different second path of travel at different angles toward said goalie in front of said hockey goal.

* * * * *